US005697877A

United States Patent [19]

Roth

[11] Patent Number: 5,697,877

[45] Date of Patent: Dec. 16, 1997

[54] APPARATUS FOR FEEDING PACKAGING MACHINES

[75] Inventor: Oscar Roth, Waltenschwil, Switzerland

[73] Assignee: Involdes AG, Buenzen, Switzerland

[21] Appl. No.: 536,530

[22] Filed: Sep. 29, 1995

[30] Foreign Application Priority Data

Nov. 8, 1994 [CH] Switzerland ..... 3331/94

[51] Int. Cl.[6] ..... B65H 45/12

[52] U.S. Cl. ..... 493/162; 53/579; 493/177; 493/182; 493/416

[58] Field of Search ..... 493/162, 178, 493/180, 182, 177, 416; 53/574, 578, 579

[56] References Cited

U.S. PATENT DOCUMENTS

| | | | |
|---|---|---|---|
| 3,287,011 | 11/1966 | Currie, Jr. . | |
| 3,401,609 | 9/1968 | Nelson . | |
| 3,968,623 | 7/1976 | Langen | 493/182 |
| 4,735,600 | 4/1988 | Drewke | 493/314 |
| 4,917,663 | 4/1990 | Pazdernik | 53/579 |

FOREIGN PATENT DOCUMENTS

| | | |
|---|---|---|
| 1288990 | 9/1991 | Canada . |

*Primary Examiner*—Jack W. Lavinder

*Attorney, Agent, or Firm*—Karl Hormann

[57] ABSTRACT

An apparatus for periodically feeding a packaging machine with semi-finished packages formed from flat blanks (2), provided with a magazine (6) for storing such blanks (2), a feed path (11) extending in a feed plane (13) with a pair of feed dogs (16), spaced from each other at a distance corresponding to the size of the blank (B), periodically entering the feed path. In cooperation with a transfer apparatus (24-34) reciprocally moving in the feed direction (A) the pair of feed dogs (16) shapes a blank (2) withdrawn from the magazine (6) to a semi-finished package suitable for being filled, and then feeds the semi-finished package to stations in the packaging machine where it is filled and completed. To prevent faulty transfers or deposits, the blanks (2) are stored within their magazine (6) in an upright orientation such that those blank sections (B,F) first entering into the feed path (11) extend above the feed plane (13). In a first terminal position the transfer apparatus (24-34) seizes the blank section (F,D) extending above the plane (13) of the feed path (11), moves it between the pair of feed dogs (16) and releases the blank (2) when in its other terminal position. At the area (17) at which the feed dogs (16) enter into the feed path (11), means (20,21,23) are provided for positively holding the side margins (S) of the blank section (B) immediately following the seized blank section (F) in the plane (13) of the feed path (11).

19 Claims, 2 Drawing Sheets

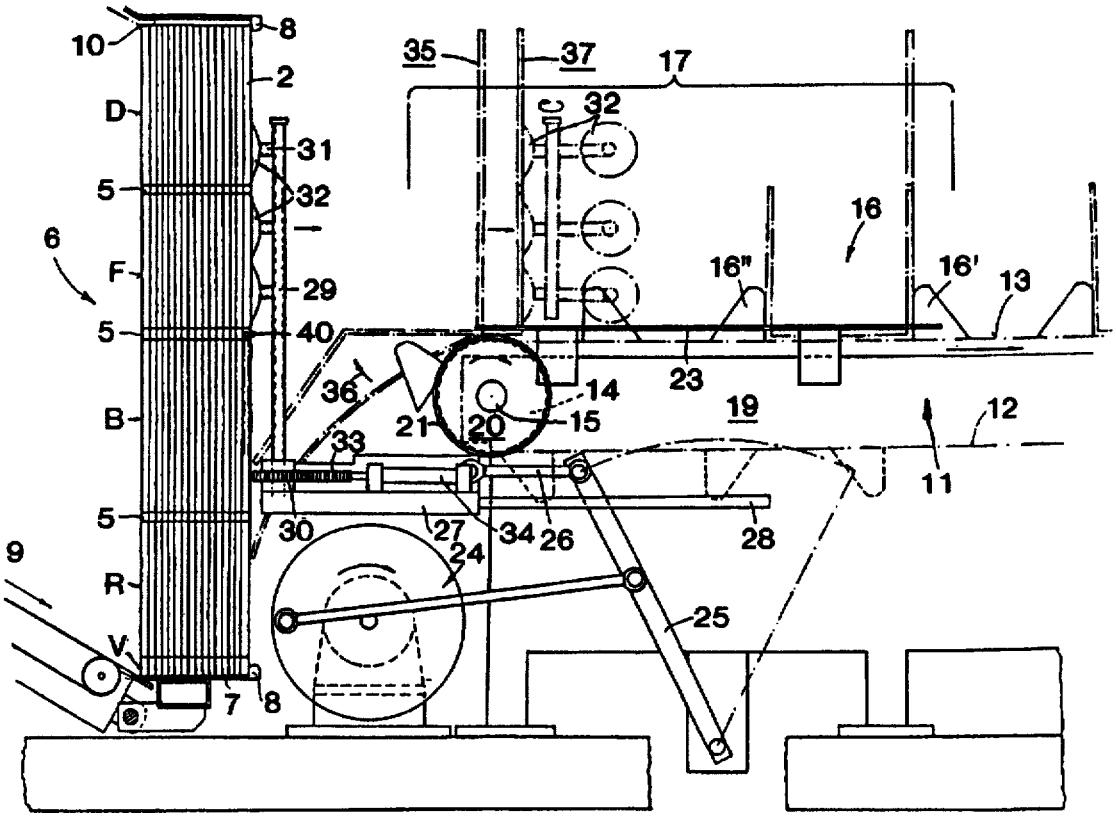
FIG. 3
FIG. 4
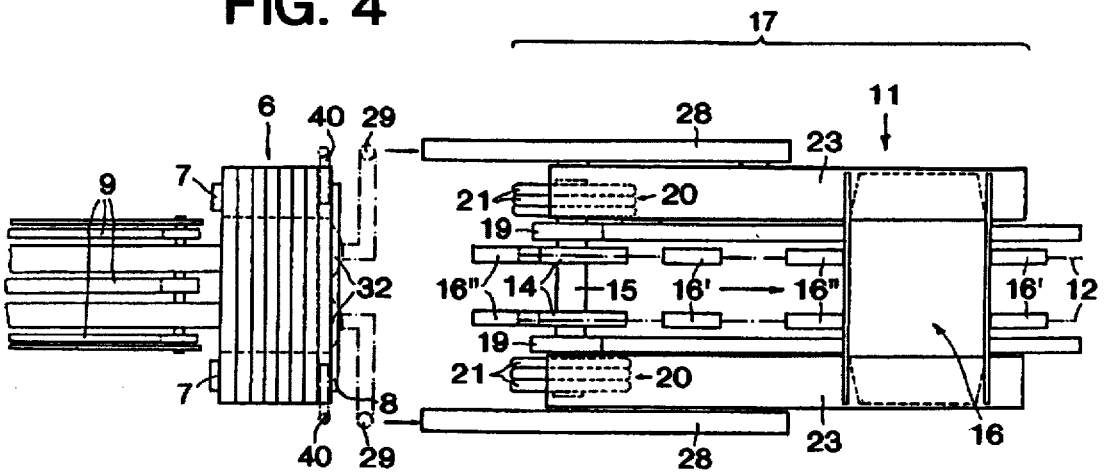

APPARATUS FOR FEEDING PACKAGING MACHINES

BACKGROUND OF THE INVENTION

1. Field of the Invention

The invention, in general, relates to an apparatus for feeding packaging machine's with package blanks and, more particularly, to an apparatus for successively feeding individual substantially flat package blanks from a magazine thereof to a package preforming station along a planar feed path of a packaging machine for forming a semi-finished package suitable for filling.

2. The Prior Art

An apparatus of this kind is generally known from Canadian patent No. 1,288,990. In the apparatus there shown, flat blanks made of corrugated cardboard are retained in a magazine at an inclination relative to a feed path. The lowest blank at the bottom of the inclined stack is seized by a transfer device at a section which eventually will constitute the bottom of the package, and is then transferred in a substantially elliptical movement onto a feed path, between a pair of feed dogs. Thereafter, the blank is held by the transfer device until the blank has been converted by the feed dogs into a semi-finished package suitable for receiving goods to be packaged.

Any air will have been pressed out, or will at any rate have escaped, from between the individual blanks of the stack in the magazine. Thus, when the lowest blank is withdrawn by the transfer device, a vacuum is formed between it and the next adjacent blank. The latter may, therefore, be pulled or sucked out of the magazine along with the lowest blank. Such faulty or defective withdrawal or deposit requires the apparatus to be stopped, along with the packaging machine connected to it, so that the excess blank may be manually removed. To prevent such faulty deposits, adjustable pins or catches are provided near the magazine, the tips of which penetrate slightly into the sides of the second blank to prevent its being dragged along by the first blank. However, every change in format or quality of the blanks requires these pins to be optimally and precisely adjusted while the machine is running. It will appreciated that this may entail significant interruptions or down times.

A further disadvantage of the known apparatus is the complicated structure of its transfer device for moving the suction cups through their elliptical transfer path.

OBJECTS OF THE INVENTION

It is accordingly an object of the present invention to provide an apparatus of the kind described which does not suffer from any of the disadvantages of the prior art apparatus.

A further object of the invention resides in the provision of an apparatus of simple construction for successively feeding single package blanks into a packaging machine.

It is also an object of the invention to provide a transfer apparatus in a machine of the kind described which effectively avoids the removal of more than one package blank from a magazine thereof, during any operating cycle.

Yet another object of the invention is to provide a transfer apparatus of the kind referred to which does not require an elliptical path of movement for transferring a blank from a magazine to a feed path.

It is also an object of the invention to provide a transfer apparatus which moves and is effective in a substantially linear path of movement.

Other objects will in part be obvious and will in part appear hereinafter.

SUMMARY OF THE INVENTION

In accordance with a currently preferred embodiment of the invention, there is provided an apparatus for periodically feeding initially substantially flat package blanks individually from a stack thereof stored within a magazine to an input section of a feed path of a packaging machine for initial forming into semi-finished packages suitable for filling, the feed path being effective in a given plane and provided with conveying means including at least one pair of leading and trailing (in the direction of movement) feed dogs successively moving into the input section and spaced from each other by a distance determined by the size of a given blank section. The feed dogs cooperate with a transfer apparatus reciprocally movable relative to the feed direction, and move the semi-finished package along the feed path for filling and subsequent finishing of the package. They also serve to fold a plurality of blank section with respect to each other into the shape of a semi-finished package. In a preferred embodiment, the blanks are stored within the magazine in an upright or vertical orientation such that the section of the blank which is leading on the feed path is disposed above the plane thereof. The transfer apparatus, in a first terminal position, seizes a section of the blank extending above the feed path for moving the section abutting the seized one between a pair of feed dogs, and in a second terminal position releases the blank section. Furthermore, means is provided in the region of the feed dogs entering the feed path for positively retaining the section of the blank adjoining the seized section in the feed plane.

BRIEF DESCRIPTION OF THE SEVERAL DRAWINGS

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

FIG. 1 depicts a package useful for shipping and storing cans, bottles and the like;

FIG. 3 is a schematic side elevation of an apparatus in accordance with the invention; and FIG. 4 is a schematic top elevational view of the apparatus depicted in FIG. 3 with certain parts thereof eliminated for clarity.

DETAILED DESCRIPTION OF THE INVENTION

The apparatus described with reference to FIGS. 3 and 4 is of the kind useful for preparing a package 1 (FIG. 1) to a semi-finished condition in which it may be filled. In the context of the present description, the terms "intermediate shape" and "semi-finished package" are used substantially synonymously and refer to a semi-assembled package, usually of cardboard stock, suitable for filling.

Figure 2:
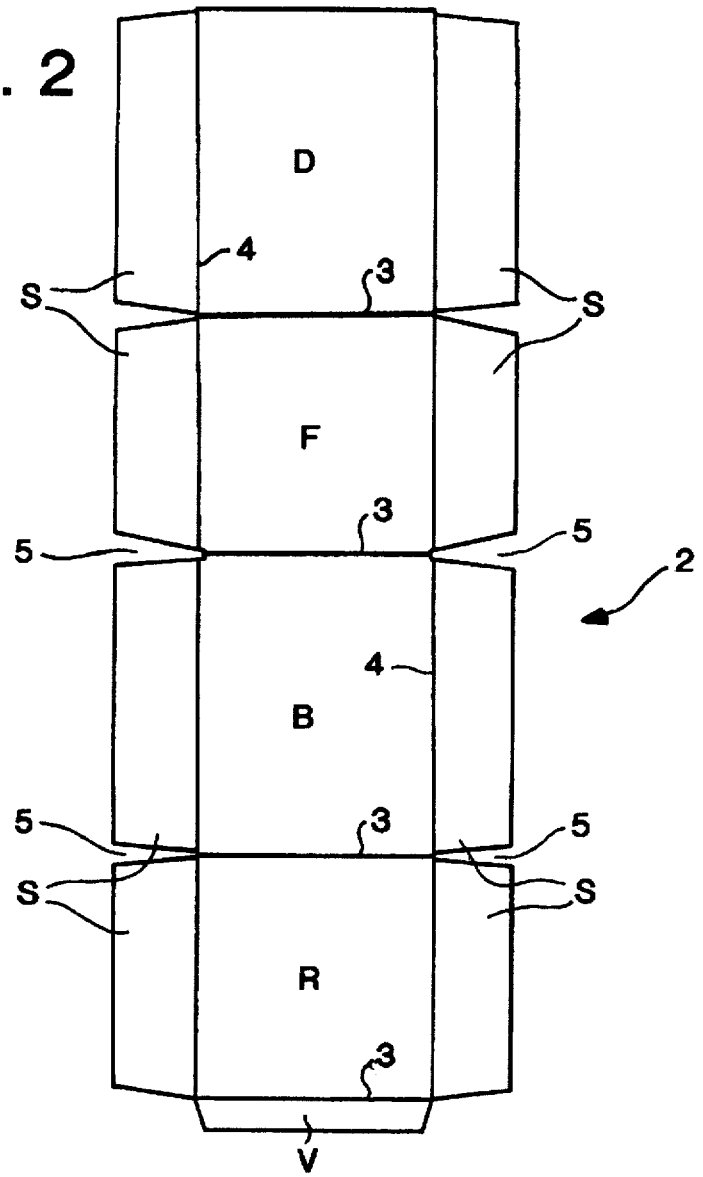
FIG. 2 shows a blank for forming the package of FIG. 1.
Figure 1:
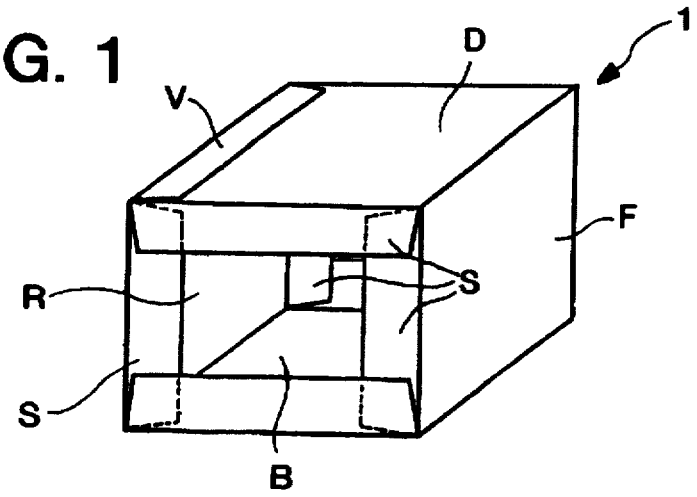

A package 1 of the kind here under consideration typically consists of a bottom section B, a forward wall F, a rear wall R, a lid D and lateral or side flaps S connected thereto, as well as a closure flap V connected to the rear wall R. It will be appreciated that these are arbitrary appellations chosen with reference to the order in which they are depicted in FIG. 1. The side flaps S, when adhesively connected to each other, in effect constitute side walls which, depending on the width of the side flaps S, may be open or closed. In a finished package, the closure flap V will be adhesively connected to the lid D. All these package sections are formed in one piece as a flat blank 2 (FIG. 2), and are distinct from one another by fold lines 3 and 4 and by cut-out notches 5. To fill a package 1, it is first folded into an intermediate shape by folding the front wall F with the lid D attached thereto as well as the rear wall R with its closure flap V about fold lines 3 into an upward or vertical disposition. In the semi-finished package the side flaps S still extend coplanarly from their adjacent package sections B, F, R and D. An article to be packaged is laterally pushed onto the bottom section. B of the intermediate or semi-finished package, and thereafter the remaining sections are folded over and glued together to form a finished package with the article packaged therein.

The blanks 2 to be successively or periodically transferred are stored in a substantially vertical disposition in a magazine 6 on a vertically adjustable support plate 7 thereof. The magazine 6 is provided with an opening facing the apparatus to be described. Upper and lower retaining lips 8 are provided at opposite, for instance the upper and lower, margins of the opening and serve to engage, with slight resistance, upper and lower marginal portions of the forwardmost blank 2 of a horizontal stack in order releasably to retain the blanks 2 within the magazine 6 and to prevent them from accidentally escaping therefrom. An inclined conveyor belt 9 moving in a downward direction is provided for continually replenishing the blanks 2 in the magazine 6. The replenished blanks 2 initially contact those blanks 2 which are already in the magazine 6 at point 10. The blanks 2 are then "fanned", i.e. separated, by the conveyor belt 9 at their lower portion to allow air to enter between individual blanks 2 before they are successively placed into their depicted substantially vertical orientation on the plate member 7.

A feed path 11 is extending from the magazine 6 for feeding semi-finished package blanks 2 through an input section 17 to more remote loading stations of the packaging machine. The feed path 11 essentially consists of a pair of endless chains 12 driven by a motor (not shown). The conveying and pulled upper strands of each chain 12 moves in a feed plane 13, in the direction of an arrow A. The chains 12 are guided around idler wheels or sprockets 14 rotatably mounted on, or rotatable with, a rotatably journalled shaft 15. The chains 12 are provided with feed dogs 16 arranged as consecutive pairs spaced from each other at regular intervals. Seen in the direction of movement, each pair of feed dogs 16 respectively consists of leading and trailing dogs 16' and 16" mounted on each of the two feed chains 12 and provided with substantially vertically disposed surfaces facing each other.

The feed dogs 16 enter the input section 17 of the feed path 11 as the leading and trailing dogs 16' and 16" are in sequence moved around the idlers 14 from the lower to the upper strands of the chains 12. During this transition, they seize a blank 2 in a manner to be described. The shaft 15 is journalled for rotation in two parallel plates 19 vertically mounted on opposite sides of a machine frame. At the sides of the plates 19 facing away from each other, a roller 20 is affixed to the shaft 15. In a manner resembling a solid rubber tire, an elastic ring 21, preferably having a high surface friction, is mounted on the periphery of each roller 20. The outer diameter of the rings 21 is somewhat larger than the pitch diameter of the idler sprockets 14. Therefore, the circumferential speed of the rings 21 is somewhat greater, preferably by about 5% to about 10%, than the feeding speed of the pair of chains 12.

A guide rail 23 is mounted on each of the plates 19 at a small distance above, and extending over, the roller 20 adjacent to it. The rail 23 is disposed in parallel to the feed plane 13, and its lower surface constitutes a smooth, preferably polished guide surface. At one of their ends, the guide rails 23 are extending slightly forward of the shaft 15, and at their other ends they terminate near or at the input section 17.

The apparatus is provided with a crank drive 24 for pivoting a rocker arm 25 back and forth between two terminal positions relative to the feed direction, as shown in FIG. 3. The rocker arm 25 is in turn connected by two arms 26 to two carriages 27 which are linearly movable along guide tracks 28 mounted in parallel to the feed direction.

The guide tracks 28 are affixed to the plates 19 on their sides facing away from each other. A tube 29 with a pinion 30 affixed to its lower end, is rotatably mounted in each of the carriages 27. Three short tube stubs 31 are extending angularly from each tube 29, each stub 31 being provided at its free end with a suction cup 32 made of an elastic material. The suction cups 12 function as suction grippers and may be connected to a source of vacuum pressure (not shown) by means of a valve (also not shown) controlled in such a manner that during each operating cycle the suction cups 32 may be alternately subjected to vacuum and ambient pressures.

Each pinion 30 meshingly engages a toothed rack 33 connected to a piston rod of a hydraulically or pneumatically operating piston drive 34 affixed to each carriage 27. Preferably, the piston drive is a reciprocating dual-action one. When pressurized, each piston drive will cause its piston rod to move its associated toothed rack 33. Such movement, in turn, leads to a corresponding rotation of the tube 29 by 90°, as shown in FIG. 3.

The described apparatus operates in the following manner: During each operational cycle, the continuously running pair of chains 12 advances a pair of feed dogs 16 into the input section 17. As the leading feed dogs 16' arrive in the feed plane 13, the suction cups 32, as shown in solid lines in FIG. 3, being then under vacuum pressure, seize the forwardmost blank 2 in the magazine 6. The suction cups 32 will engage the blank 2 in the area of its front wall F and preferably also in the area of the lid D. At this point in time, the suction cups 32 will be connected to vacuum pressure, and the carriages 27 will be in one of their two terminal positions along their guide rails 28. Before the trailing feed dogs 16" arrive at the input section 17 of the feed path 11, the crank drive 24 moves the carriages 27 into their other terminal position. During this movement, the suction cups 32 will remain connected to vacuum pressure and pull the front wall F and the lid D of the seized blank 2 in the feed direction while maintaining blank sections F and D in their vertical orientation. The other sections B, R, V of the blank 2 and their adjoining side flaps S which are positioned in the magazine 6 below the feed plane 13, are also pulled out of the magazine 6 and are pulled against and over the rollers 20 (at position 35 in FIG. 3). As indicated by arrow 36, during their continuing movement the sections B, R, V are together folded upwardly, around the fold line 3 separating sections F and B, into a substantially horizontal orientation in the feed plane 13, by their engagement with the rollers 20. Thereafter, the side flaps S extending laterally from the bottom section B are drawn into the nip formed between the underside of the guide rails 23 and the rollers 20. Because of the elastic deformation of the rings 21, the flaps S are frictionally advanced by them at a speed in excess of the speed of the pair of chains 12, until the front wall section F of the blank 2 abuts the vertical surface of the leading feed dogs 16' As the carriages 27 are moving at substantially the same speed as the circumferential speed of the rings 21, they will arrive at their other terminal position (position 37) when the blank 2 has been seized by the rollers 20, but in no event later than when the rollers 20 have moved the blank 2 into engagement with the leading feed dog 16'. When the carriages 27 have arrived in their other terminal position, vacuum pressure to the suction cups 32 is switched to normal or ambient pressure, and the suction cups 32 will release the blank 2. At the same time, or shortly thereafter, the suction cups 32 are pivoted outwardly by 90°, out of the feed path of the blank 2, by actuation of the piston drive 34 and a corresponding displacement of the toothed racks 33. Thereafter, the carriages 27 are returned to their first terminal position and the operational cycle is repeated.

Advantageously, finger-like flat hold-down members 40 may be moved in synchronism with each of the carriages 27 or with the suction cups 32, as the case may be. Each of the fingers 40' is mounted for pivotal movement about an axis parallel to the tubes 29 and is disposed in the feed plane 13. The upper side of each finger 40 is positioned slightly lower than the underside of the guide rails 23. When the suction cups 32 are in their position shown in solid lines in FIG. 3, the fingers 40 are pivoted into those notches 5 of the forward blank 6 in the magazine 6 which are aligned with the feed plane 13. The fingers 40 remain within the notches 5, and while the blank 2 is being moved into the feed path 11, they 40 follow the suction cups 32 until they have moved beyond position 35 and the lower edges of the notches 5 are positioned below the guide rails 23 and have been nipped by the rollers 20. At that instant, the fingers 40 are pivoted out of the feed path of the blank 2, and, together with the suction cups 32, they are returned to their position shown in FIG. 3. The fingers 40 lend positive support to the lower edges of the notches 5 which are aligned with the feed plane 13 while they are moving out of the magazine 6 and below the guide rails 23. For this reason, even strongly warping or buckling blanks 2 may be securely moved into the effective range of the rollers 20.

At the same time as the side flaps S of the bottom B enter the nip of the rollers 20 (position 37), the trailing feed dogs 16" are advanced from below into the feed plane 13. During this movement, the trailing feeds dog 16" fold the rear wall section R and its side flaps S together with the closure flap V upwardly about the fold line 3 between sections B and R, until the surface of section R intimately abuts the leading vertical flank of the feed dog 16". The section R will then be disposed substantially normal to the feed plane 13. During this operation, the side flaps S of the bottom section B are held down by the guide rails 23 so that the bottom section B is moving in the feed plane 13. Once the rear wall R has been pivoted upwardly, the preforming of the package into its semi-finished condition suitable for filling is completed, and the semi-finished package, retained between the pair of leading and trailing feed dogs 16' and 16", will be conveyed to a filling station (not shown) located further down the feed path.

Since the rollers 20 serve not only to propel the side flaps S of the bottom B, but also to pivot upwardly (arrow 36) those blank sections B, R, V which are trailing blank sections F and D, they serve also as guide members for guiding sections R and V of the blank 2 into a position in which the trailing feed dog 16" can engage section F for pivoting it into its vertical orientation in the manner described.

It will be apparent to those skilled in the art that the feed or transfer apparatus of the present invention may constructed in many different ways. However, two elements are believed to be essential: First, that the suction cups 32 transfer the front wall F of a blank 2 in a vertical orientation relative to the feed plane 13 and in the direction of movement of the feed path 11 and, second, that the bottom B of the package is retained in positive contact with the feed plane 13 while the blank 2 is being preformed into an intermediate shape suitable for filling. Instead of guide rails 23 other hold-down means, such as rollers and the like, may be provided.

What is claimed is:

1. An apparatus for successively feeding individual substantially flat package blanks (2) comprising a plurality of longitudinally connected foldable sections (B,R,F,D,V) of predetermined lengths to a packaging machine, comprising:

a feed path (11) comprising an input section (17) and extending therefrom in a predetermined plane (13) and comprising means (12) moving at a predetermined speed within said plane (13) into a predetermined direction (A);

leading and trailing feed dog means (16',16") mounted on said moving means (12) and comprising opposing abutment surfaces spaced at intervals substantially corresponding to the length of one of said sections (B);

a magazine (6) for storing a plurality of said blanks (2) in an orientation substantially normal to and intersecting said feed plane (13) such that at least a first one (F) of said foldable sections is positioned above and at least second (B) and third (R) foldable sections are positioned below said feed plane (13), said magazine (6) comprising an opening facing said feed path (11) and aligned in parallel with said foldable sections (D,F,B, R);

transfer means (29) mounted for reciprocal movement (24,25,26,27,28) parallel to and above said feed plane (13) between a first position adjacent to said magazine (6) and a second position (37) remote therefrom;

means (32) mounted on said transfer means (29) for seizing through said opening, when said transfer means (27,29) is substantially in its first position, said first section (F) of said foldable (2) for moving it onto said moving means (12) in said normal orientation and into engagement with said abutment surface of said leading feed dog means (16') thereby to draw said second foldable section (B) onto said moving means (12) in a substantially parallel engagement therewith, whereby said abutment surface of said trailing feed dog means (16") moves into engagement with said third foldable section (R) for folding it upwardly into an orientation substantially normal to said second (B) and parallel to said first foldable section (F), and for releasing said first foldable section (F) when said transfer means (27,29) is substantially in its second position (37).

2. The apparatus of claim 1, further comprising hold-down means (23) substantially at said input section (17) for maintaining said second section (B) on said plane (13) in parallel engagement therewith.

3. The apparatus of claim 2, wherein said magazine (6) is provided with means (8) extending into said opening into engagement with opposite marginal portions of a blank (2) adjacent to said opening.

4. The apparatus of claim 3, wherein said moving means comprises a endless conveyor means (12).

5. The apparatus of claim 4, wherein said endless conveyor means (12) comprises a pair of chains extending in parallel to each other, said chains being trained around first roller means (19) mounted for rotation about an axis (15) parallel to said window intermediate said first and second (37) positions of said transfer means (27,29).

6. The apparatus of claim 5, further comprising arcuate guide means (20,21) mounted coaxially with said first roller means (19) and adapted to intersect said second blank section (B) being drawn onto said conveyor (12), said feed plane (13) being substantially tangential to the periphery (21) of said arcuate guide means (20).

7. The apparatus of claim 6, wherein at least said second foldable section (B) is provided with lateral extensions (S) and wherein said hold-down means (23) is extending from said arcuate guide means (20) on opposite sides of said conveyor means (12).

8. The apparatus of claim 7, wherein said hold-down means (23) comprises rail means for engaging an upper surface of said extensions.

9. The apparatus of claim 8, wherein said arcuate guide means (20,21) comprises guide roller means (20,21) positioned below said rail means (23) to form a gap therewith for resiliently engaging opposite surfaces of said extensions (S).

10. The apparatus of claim 9, wherein said rail means (23) is provided with a low-friction smooth surface (21) for engaging said extensions (S).

11. The apparatus of claim 10, wherein resilient friction rings (21) are circumferentially mounted on said guide roller means (20).

12. The apparatus of claim 11, wherein said guide roller means (20,21) are rotatably driven at a circumferential speed greater than said predetermined speed of said conveyor means (12).

13. The apparatus of claim 12, wherein means (40) is provided for guiding said extensions (S) of said second blank section (B) during its movement into said gap between said guide roller means (20) and said rail means (23; 20,21).

14. The apparatus of claims 1, wherein said transfer means (29) is mounted on slide means (27) reciprocally driven in a direction parallel to said feed path (11).

15. The apparatus of claim 14, wherein said transfer means (29) comprises vacuum means (31,32) for seizing said first foldable section (F) during movement of said transfer means (27,29) between its said first and second (37) positions.

16. The apparatus of claim 15, wherein said vacuum means comprises suction cup means (32).

17. The apparatus of claim 16, wherein said suction cup means (32) is mounted for movement (30,33) between a first orientation in which said suction cup means (32) is aligned with said first foldable section (F) and a second orientation laterally displaced from said first orientation.

18. The apparatus of claim 1, wherein said magazine (6) is provided with plate means (7) for supporting said blanks (2), said plate means (7) being mounted for adjustment in a direction normal to said feed path (11).

19. An apparatus for successively feeding individual substantially flat package blanks (2) comprising a plurality of longitudinally connected foldable sections (D,F,B,R,V) of predetermined lengths to a packaging machine for initial forming into a semi-finished package suitable for filling, comprising:

a feed path (11) extending in a predetermined plane (13) and comprising means (12) moving at a predetermined speed within said plane (13) into a predetermined direction (A);

leading and trailing feed dog means (16',16") connected to said moving means (12) and comprising opposing abutment surfaces spaced at intervals substantially corresponding to the length of one of said foldable sections (B);

a magazine (6) for storing a plurality of said blanks (2) in an orientation substantially normal to and intersecting said feed plane (13) such that at least a first one (F) of said foldable sections (2) is positioned above and at least second (B) and third (R) foldable sections (2) are positioned below said feed plane (13), said magazine (6) comprising an opening facing said feed path (11) and aligned in parallel with said foldable sections;

transfer means (29) mounted for reciprocal movement (24,25,26,27) parallel to and above said feed plane (13) between a first position adjacent said magazine (6) and a second position (37) remote therefrom;

means (32) mounted on said transfer means (29) for seizing through said opening, when said transfer means (29) is in its first position, said first foldable section (F) of a blank (2) for moving it onto said moving means (12) in said normal orientation and into engagement with said abutment surface of said leading feed dog means (16') thereby to draw said second foldable section (B) onto said moving means (12) into substantially parallel engagement therewith whereby said abutment surface of said trailing feed dog means (16") moves into engagement with said third foldable section (R) for folding it upwardly into an orientation substantially normal to said second (B) and parallel to said first (F) foldable section thereby to provide said semi-finished package, and for releasing said first foldable section (F) when said transfer means (29) is substantially in its second position (37).

* * * * *